US009976253B2

(12) United States Patent
Tichy et al.

(10) Patent No.: US 9,976,253 B2
(45) Date of Patent: May 22, 2018

(54) SET FOR THE MECHANICAL PROCESSING, IN PARTICULAR GRINDING OF SUSPENDED FIBROUS MATERIAL

(71) Applicant: ANDRITZ FIEDLER GMBH, Regensburg (DE)

(72) Inventors: Christoph Tichy, Regensburg (DE); Wolfgang Beer, Regensburg (DE); Thomas Mickelat, Nittenau (DE); Peter Antensteiner, Lewisburg, PA (US)

(73) Assignee: Andritz Fiedler GmbH, Regensburg (DE)

( * ) Notice: Subject to any disclaimer, the term of this patent is extended or adjusted under 35 U.S.C. 154(b) by 0 days. days.

(21) Appl. No.: 15/315,212

(22) PCT Filed: Jun. 24, 2015

(86) PCT No.: PCT/EP2015/001276
§ 371 (c)(1),
(2) Date: Nov. 30, 2016

(87) PCT Pub. No.: WO2015/197192
PCT Pub. Date: Dec. 30, 2015

(65) Prior Publication Data

US 2017/0191218 A1 Jul. 6, 2017

(30) Foreign Application Priority Data

Jun. 27, 2014 (DE) ..... 10 2014 009 588

(51) Int. Cl.
*B02C 7/12* (2006.01)
*D21D 1/30* (2006.01)
(Continued)

(52) U.S. Cl.
CPC ..... *D21D 1/306* (2013.01); *B02C 7/12* (2013.01); *D21D 1/00* (2013.01); *D21D 1/008* (2013.01); *D21D 1/22* (2013.01); *D21D 1/30* (2013.01)

(58) Field of Classification Search
CPC .. B02C 7/13; B02C 18/00; B02C 2/10; B02C 7/182; B02C 7/02; B02C 7/12;
(Continued)

(56) References Cited

U.S. PATENT DOCUMENTS 1,939,968 A * 12/1933 Frei, Jr. ..... E01F 9/627 116/63 R
3,278,127 A 10/1966 Russell
(Continued)

FOREIGN PATENT DOCUMENTS

DE 197 54 807 A1 6/1999
DE 102 58 324 A1 7/2004
EP 1 584 741 A1 10/2005

OTHER PUBLICATIONS

International Search Report issued by the European Patent Office in International Application PCT/EP2015/001276.

*Primary Examiner* — Anthony Stashick
*Assistant Examiner* — Onekki Jolly
(74) *Attorney, Agent, or Firm* — Henry M. Feiereisen LLC

(57) ABSTRACT

A set for mechanical processing suspended fibrous material includes a die plate having receiving openings in a predefined arrangement for insertion of blade-shaped processing elements which jut out on a process side and are flowed onto by the fibrous material. The blade-shaped processing elements have each a plurality of foot regions in longitudinally spaced-apart relation, which pass through the die plate (2) and jut out from the die plate on a process-distal. At least some of the foot regions of the processing elements reach
(Continued)

into associated receiving grooves of a base plate on the process-distal side. As an alternative, transverse stiffening elements are arranged substantially orthogonally in the longitudinal direction of the processing elements such that the transverse stiffening elements stabilize the foot regions of the processing elements on the process-distal side.

12 Claims, 13 Drawing Sheets

(51) Int. Cl.
*D21D 1/00* (2006.01)

*D21D 1/22* (2006.01)

(58) Field of Classification Search
CPC ..... D21D 1/006; D21D 1/22; D21D 1/303; D21D 1/30; A47J 43/255

USPC ..... 241/261.1, 261.2, 261.3, 296, 298
See application file for complete search history.

(56) References Cited

U.S. PATENT DOCUMENTS

| | | | | |
|---|---|---|---|---|
| 3,910,511 | A * | 10/1975 | Leider | B02C 7/06 241/261.3 |
| 4,270,873 | A * | 6/1981 | Laehy | A63C 19/062 256/1 |
| 4,681,270 | A * | 7/1987 | Oberhofer | D21D 1/22 241/298 |
| 5,249,734 | A | 10/1993 | Pilao | |
| 5,921,486 | A | 7/1999 | Matthew | |
| 6,363,601 | B1 | 4/2002 | Schneid | |
| 6,422,496 | B1 * | 7/2002 | Doelle | B02C 7/04 241/261.2 |
| 6,607,153 | B1 * | 8/2003 | Gingras | B02C 7/12 241/261.2 |
| 6,935,589 | B1 * | 8/2005 | Matthew | B02C 7/12 241/261.3 |
| 7,823,822 | B2 * | 11/2010 | Raymond | B02C 7/12 241/261.2 |
| 8,292,086 | B2 | 10/2012 | Mickelat et al. | |
| 2004/0128817 | A1 * | 7/2004 | Lange | D21D 1/008 29/428 |
| 2004/0144834 | A1 * | 7/2004 | Nomoto | H01L 21/4853 228/180.1 |
| 2005/0161542 | A1 * | 7/2005 | Theut | B02C 7/12 241/298 |

* cited by examiner 1
2
3
4
10
11
12
14
11

SET FOR THE MECHANICAL PROCESSING, IN PARTICULAR GRINDING OF SUSPENDED FIBROUS MATERIAL

CROSS-REFERENCES TO RELATED APPLICATIONS

This application is the U.S. National Stage of International Application No. PCT/EP2015/001276, filed Jun. 24, 2015, which designated the United States and has been published as International Publication No. WO 2015/197192 and which claims the priority of German Patent Application, Serial No. 10 2014 009 588.6, filed Jun. 27, 2014, pursuant to 35 U.S.C. 119(a)-(d).

BACKGROUND OF THE INVENTION

The invention relates to sets for the mechanical processing, in particular grinding of suspended fibrous material, which serves as a material being treated. Such sets are used in grinding machines, so-called refiners, but also in so-called deflakers and similar devices for the mechanical processing of suspended fibrous material. A set includes a die plate which is configured in the form of a perforated plate or mask and has openings in a predetermined arrangement. Blade-shaped processing elements, which jut out on the process-proximal side, are inserted into these openings and flowed upon by the fibrous material. These blade-shaped processing elements can, optionally, have process-distal foot regions which can protrude beyond the die plate.

A set is known from U.S. Pat. No. 4,681,270 which includes a die plate or perforated plate having openings in a predetermined arrangement. Rod-shaped or blade-shaped processing elements are placed into this die plate and have tongues which project beyond the die plate on the process-distal side. After inserting the foot region of the blade-shaped processing elements through the associated openings in the die plate, the feet protruding from the bottom side are cast with polymer and in part also welded to each other. The slimmer the design of the blade-shaped processing elements, the more difficult it is to keep them on the process-proximal side in a predetermined orientation and at a predetermined constant distance from each other.

U.S. Pat. No. 5,249,734 describes a rotor disc for a refiner and a method for its production. Distance elements are hereby arranged between the blade-shaped processing elements or blade elements in order to form a channel for allowing passage of the material being treated. These distance elements can be integrally formed with dam-shaped parts to enable improved processing of the material being treated. These dam-shaped parts extend orthogonally to the extension of the blade-shaped processing elements. This construction provides only weld connections between the structural elements. Such a production process is both time-consuming and also involves great additional equipment costs.

DE 102 68 324 A1 discloses a die plate with oblong holes, wherein a blade-shaped processing element (refiner rod) is positioned per oblong hole. The refiner plate has a multi-layered sheet metal structure, and the elements to be connected to each other are fixed by welding, preferably laser welding and electron beam welding, gluing and soldering.

DE 197 54 807 C2 describes a set and method for manufacturing sets, which are referred to there as "blade sets", wherein the fastening step is a vulcanizing process and wherein a polymer is used as a binder.

U.S. Pat. No. 5,921,486 discloses replaceable refiner plates, which include alternately arranged blade-shaped processing elements (refiner rods) and distance elements (distance rods). Together with a carrier plate, the processing elements and the distance elements are connected to one another by a material joint using high-temperature soldering.

SUMMARY OF THE INVENTION

The aim of the invention is to provide sets for the mechanical processing, in particular grinding, of suspended fibrous material as mentioned above, which can be realized cost-effectively, have a structure with as few parts as possible, hold the blade-shaped processing elements operationally stable, and in which the assembly of the blade-shaped processing elements has a sufficient inherent bending stiffness.

According to the invention, provided for this purpose is a set for the mechanical processing, in particular grinding, of suspended fibrous material (material being treated), in a refiner, with a die plate (perforated plate) with openings in, a predetermined arrangement, in which blade-shaped processing elements, protruding on the process-proximal side and flown upon by the fibrous material (material being treated), are inserted, have process-distal foot regions that jut out beyond the die plate, wherein each blade-shaped processing element has a plurality of longitudinally spaced-apart foot regions, which run through the die plate and extend beyond the die plate on the process-distal side, which set is characterized in that at least some of the foot regions reach into associated receiving grooves of an additional base plate on the process-distal side.

According to an alternative embodiment, a set for the mechanical processing, in particular grinding, of suspended fibrous material (material being treated), in a refiner, is provided with a die plate (perforated plate) with openings in a predetermined arrangement, in which blade-shaped processing elements, protruding on the process-proximal side and flown upon by the fibrous material (material being treated), are inserted, have process-distal foot regions that jut out beyond the die plate, wherein each blade-shaped processing element has a plurality of longitudinally spaced-apart foot regions, which run through the die plate and extend beyond the die plate on the process-distal side, which set is characterized in that transverse stiffening elements are arranged substantially orthogonally in longitudinal direction of the processing elements such that the transverse stiffening elements stabilize the process-distal foot regions of the processing elements.

Common to both sets of the type involved here is, according to the invention, the solution approach that, in order to improve the bending stiffness and the operational stability of the blade-shaped processing elements, which are nowadays increasingly slimmer in design, the blade-shaped processing elements have a plurality of foot regions which are spaced apart in longitudinal direction and of which at least some are stabilized on the process-distal side by receiving grooves of a base plate such that the overall arrangement of the blade-shaped processing elements is reliably in spaced-apart relation to one another and stiffened in itself.

Transverse stiffening elements, which extend substantially orthogonally in the longitudinal direction of the processing elements, can be arranged on the process-distal side. These transverse stiffening elements extend preferably through the foot regions of the processing elements and hold and support the processing elements spaced-apart relation.

In such an embodiment, a kind of lattice arrangement is established on the process-distal side of the die plate by extending the transverse stiffening elements through the foot regions of the processing elements on the process-distal side to thereby improve and strengthen the overall stability of the set design. Overall, the set according to the invention can be constructed with fewer parts and can therefore be produced cost-effectively with simplified structure.

According to a preferred embodiment, the transverse stiffening elements are designed in the form of a dam, jut out beyond the die plate on the process-proximal side, and hold and support the processing elements on the process-proximal side.

In such a configuration of the set, the transverse stiffening elements fulfill a dual function, namely, on one hand, a transverse stiffening on the process-distal side as a result of the transverse stiffening elements and, on the other hand, also a transverse stiffening of the processing elements on the process-proximal side. In this way, sufficient stability can be realized, even when the processing elements are designed extremely slim, i.e., have slight material thickness and great structural height.

According to a preferred embodiment, the assembly of processing elements, die plate, and transverse stiffening elements is cast with a polymer mass on the process-distal side. The lattice-structure-like assembly of processing elements, die plate, and transverse stiffening elements allows for a better adhesive joint by the presence of the cast polymer, without encountering excessive shrinkage phenomena and warping phenomena. Adhesion breaks between metal and adhesive or resin can be reliably reduced.

The residence time of the fibrous material can be influenced in dependence on the number, the arrangement, and the process-side overhang height of the transverse stiffening elements, wherein the suspension speed between adjacent blade-shaped processing elements is reduced by deflection and backup, when a greater number of dam-like transverse stiffening elements are involved. When the distance between the dam-like transverse stiffening elements is selected smaller, the effectiveness and the capacity of the refiner are influenced accordingly.

When, for example, the upper side of the dam-like transverse stiffening element is arranged on half of the overhang height of the blade-shaped processing element, the dam-like transverse stiffening element acts as a flow barrier, whereas in other cases, the surface of the dam-like transverse stiffening elements can also act as an additional processing surface or grinding surface. The dam-like transverse stiffening elements support the blade-shaped processing elements against bending to thereby improve stability, which is particularly advantageous when slim blade-shaped processing elements are involved. As the blade-shaped processing elements and the dam-like transverse stiffening elements form a union, mutual stabilization and an increase in the resistance torque against bending stress are realized.

The process-side overhang height of the processing elements is preferably 6 to 12 mm, preferably 8 to 10 mm. The width of the processing elements can be 1 to 6 mm, preferably 1.5 to 2.5 mm. According to a further preferred embodiment, the channel width between the processing elements is 1.5 to 6 mm, preferably 1.8 to 2.5 mm.

According to a preferred embodiment, the dam-like transverse stiffening elements physically form a cohesive structure, thereby simplifying installation and handling.

In particular bushings for force introduction of fastening screws for fastening the sets to the corresponding component of the refiner are mounted in openings of the die plate.

These bushings can, preferably, be connected to the die plate by a material joint or a combination of material joint and form fit. A welded connection, soldered connection and/or adhesive bond are suitable as material joint.

Preferably, the bushings have each an anti-rotation mechanism, and this anti-rotation mechanism can be realized by a polygonal connection or a polygonal shape, so that the bushings are fixed in place in rotation direction after installation in the openings of the die plate.

In summary, it is essential in the sets according to the invention that the individual blade-shaped processing elements are inserted with the assistance of a plurality of longitudinally spaced-apart foot regions into the base plate which is combined therewith, with these processing elements being fixed in a stabilized manner on the process-distal side on the perforated plate or, optionally, are additionally designed by transverse stiffening elements on the process-distal side such as to have sufficient bending stiffness and operational stability. Furthermore, when the dam-like transverse stiffening elements are structurally linked together as a chain or strip, installation and handling are also simplified.

Overall, the invention realizes a structure which can be implemented cost-effectively and in which the blade-shaped processing elements are supported and held rigidly when used in operation.

BRIEF DESCRIPTION OF THE DRAWING

Further details, features, and advantages of the invention will become apparent from the following description of preferred embodiments with reference to the accompanying drawings, without any limiting character. It is shown in.

DETAILED DESCRIPTION OF PREFERRED EMBODIMENTS

Figure 1:
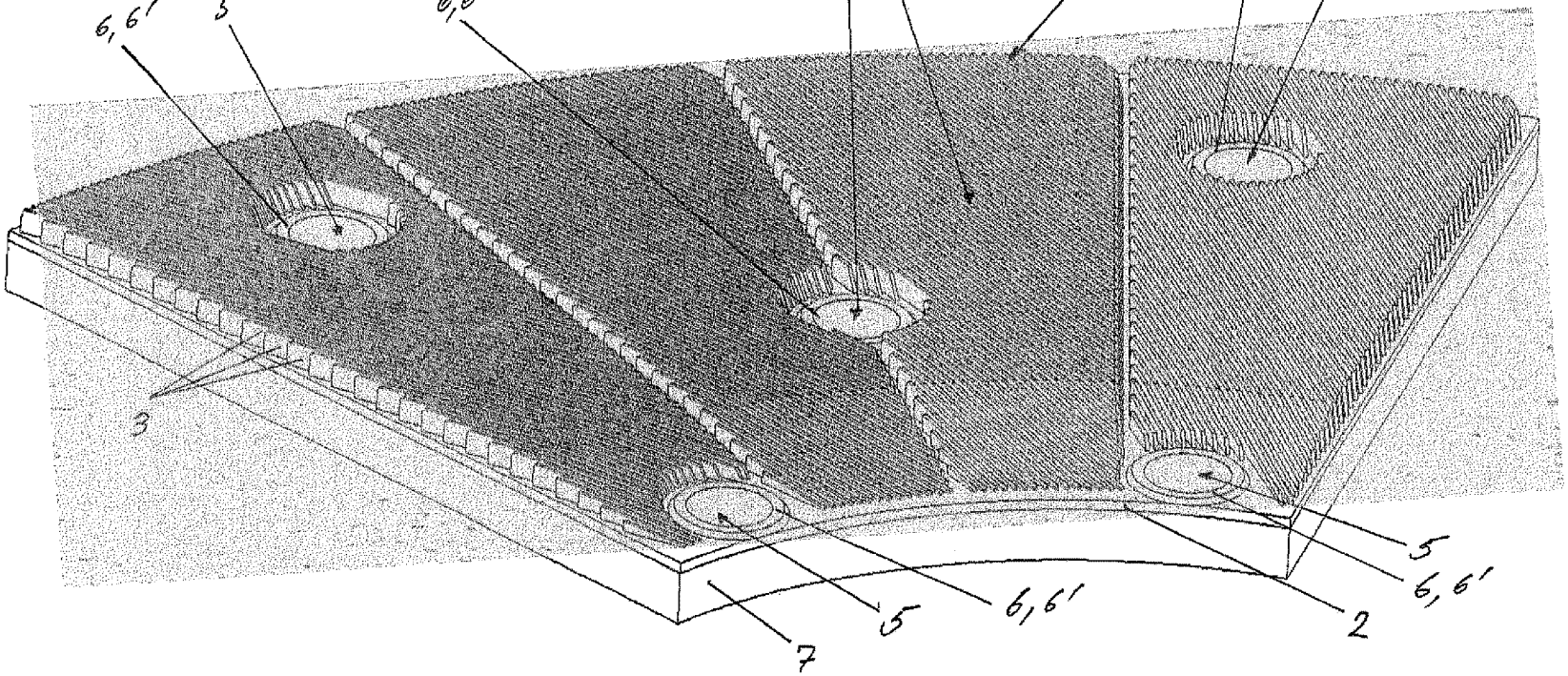
FIG. 1 a perspective overall view of an embodiment of a set as an application example of the invention, FIG. 2 a perspective view of the configuration of a set, in which the dam-like transverse stiffening elements protrude on the process-proximal side and support the blade-shaped processing elements in spaced-apart relation, FIG. 3 a perspective view of the arrangement according to FIG. 2 with an embodiment variant which has an additional base plate connected to the perforated plate, FIG. 4 a schematic arrangement of a configuration of a set according to the invention, in which both the blade-shaped processing elements and the dam-like transverse stiffening elements protrude beyond the die plate on the process-proximal side and on the process-distal side, FIG. 5 a perspective view of the arrangement of FIG. 4 in viewing direction onto the process-distal side of the set, FIG. 6 a perspective view of a blade-shaped processing element as single-piece representation, FIG. 7 a perspective view of a dam-like transverse stiffening element as single-piece representation, FIG. 8 a perspective view of an assembly of blade-shaped processing elements and dam-like transverse stiffening elements, FIG. 9 a schematic perspective view, in which, for sake of clarity, the blade-shaped processing elements are only partially inserted into the die plate, while the dam-like transverse stiffening elements are readily apparent in their inserted state, FIG. 10 an embodiment of a bushing for the force introduction of fastening screws, FIG. 11 a perspective view of an embodiment variant of a bushing for the force introduction of fastening screws, FIG. 12 a schematic perspective view of an alternative embodiment in which, for sake of clarity, the blade-shaped processing elements are only partially inserted into the die plate, FIG. 13 a schematic perspective cutaway view of a perforated plate in the embodiment variant according to FIG. 12, and FIG. 14 a perspective view of a blade-shaped processing element as single-piece representation for the embodiment variant of a set according to FIGS. 12 to 14.

In the figures of the drawing, same or similar parts are designated by the same reference numerals.

FIG. 1 shows an overall view of an exemplary embodiment of a set, generally designated by 1, which is installed on a not-shown grinding machine, a so-called refiner, and used for grinding of suspended fibrous material as well as for dispersing impurities and fibers as well as for stripping, i.e. the dissolution of fiber conglomerates. The set 1 shown in FIG. 1 by way of a top view, includes a die plate or perforated plate 2, blade-shaped processing elements 3, and dam-like transverse stiffening elements 4. In addition, FIG. 1 shows openings 5 in the die plate 2 for insertion of bushings 6 for force introduction of fastening screws. Further, in the exemplary embodiment shown in FIG. 1, a cured cast mass layer 7 is shown for stable realization of the assembly of die plate 2, blade-shaped processing elements 3, and dam-like traverse stiffening elements 4, and is preferably formed from a polymer to provide an adhesive bond as material joint of die plate 2, blade-shaped processing elements 3 and dam-like transverse stiffening elements 4.

Figure 2:
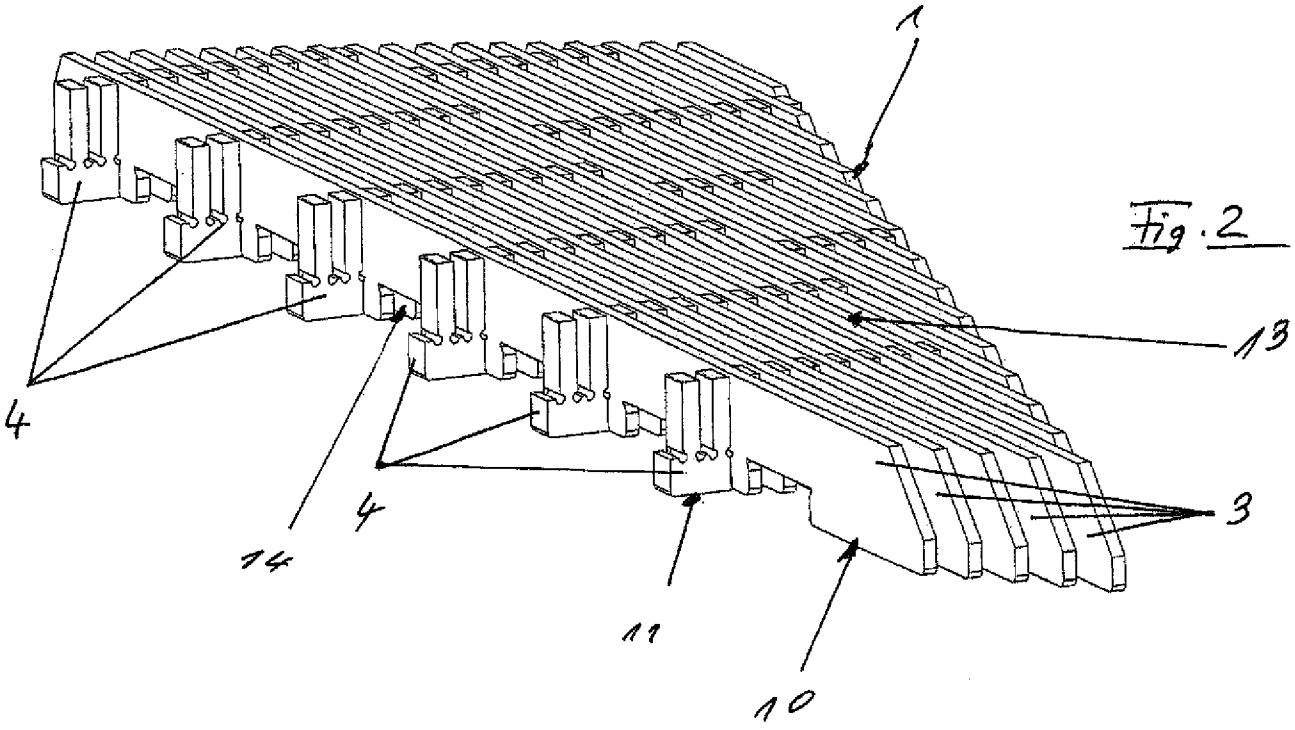
Figure 3:
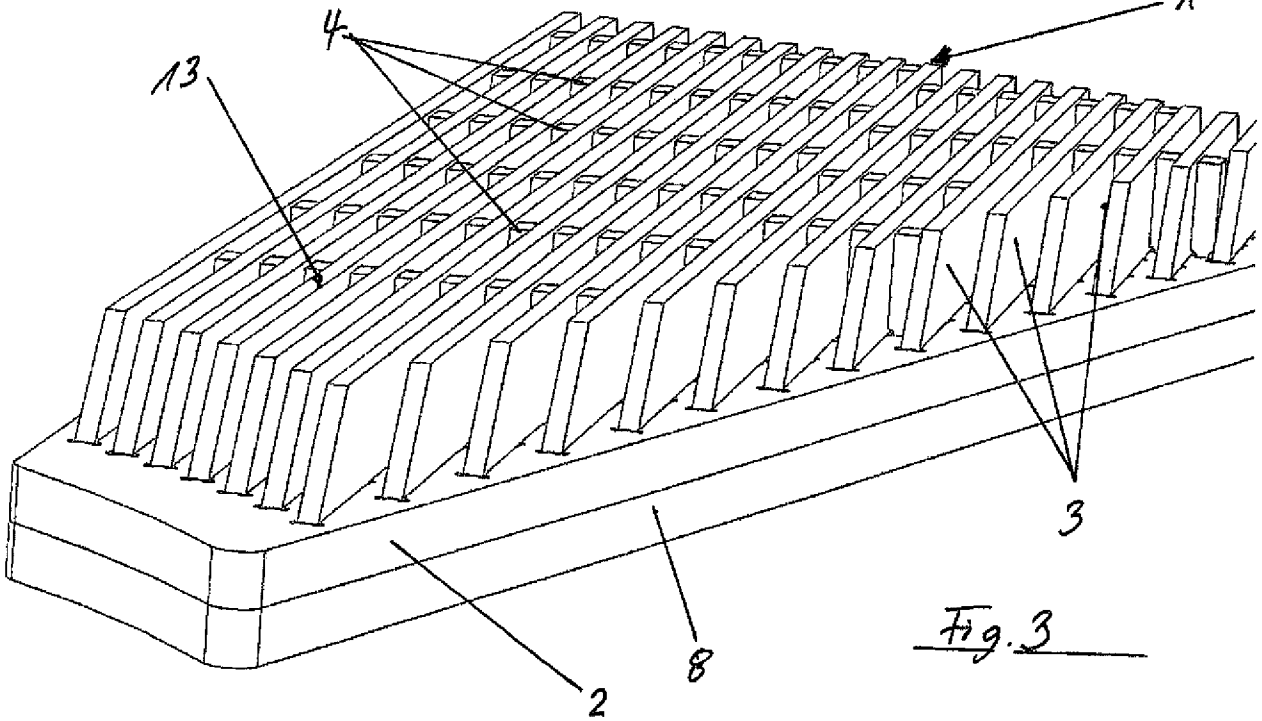
Figure 4:
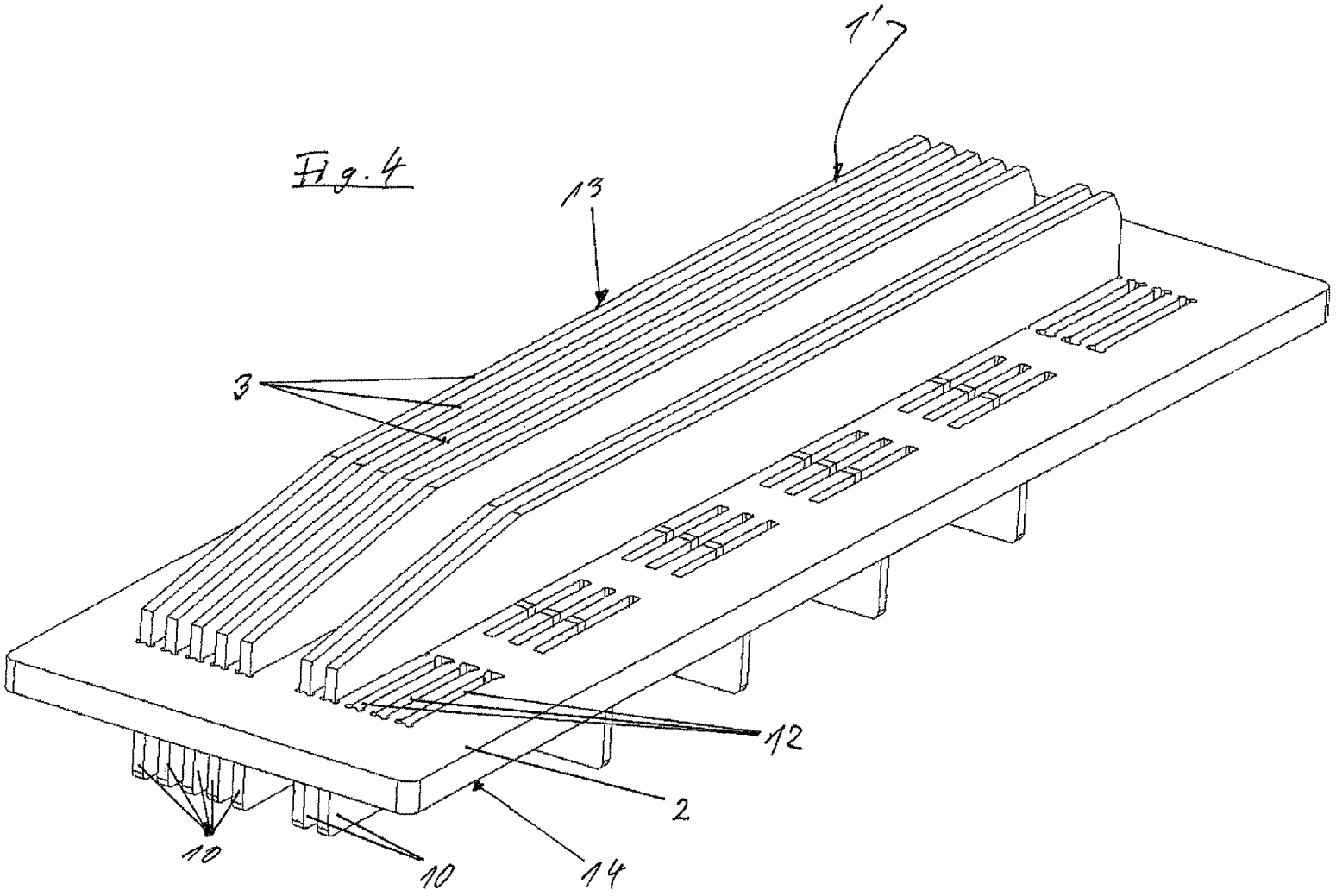
Figure 5:
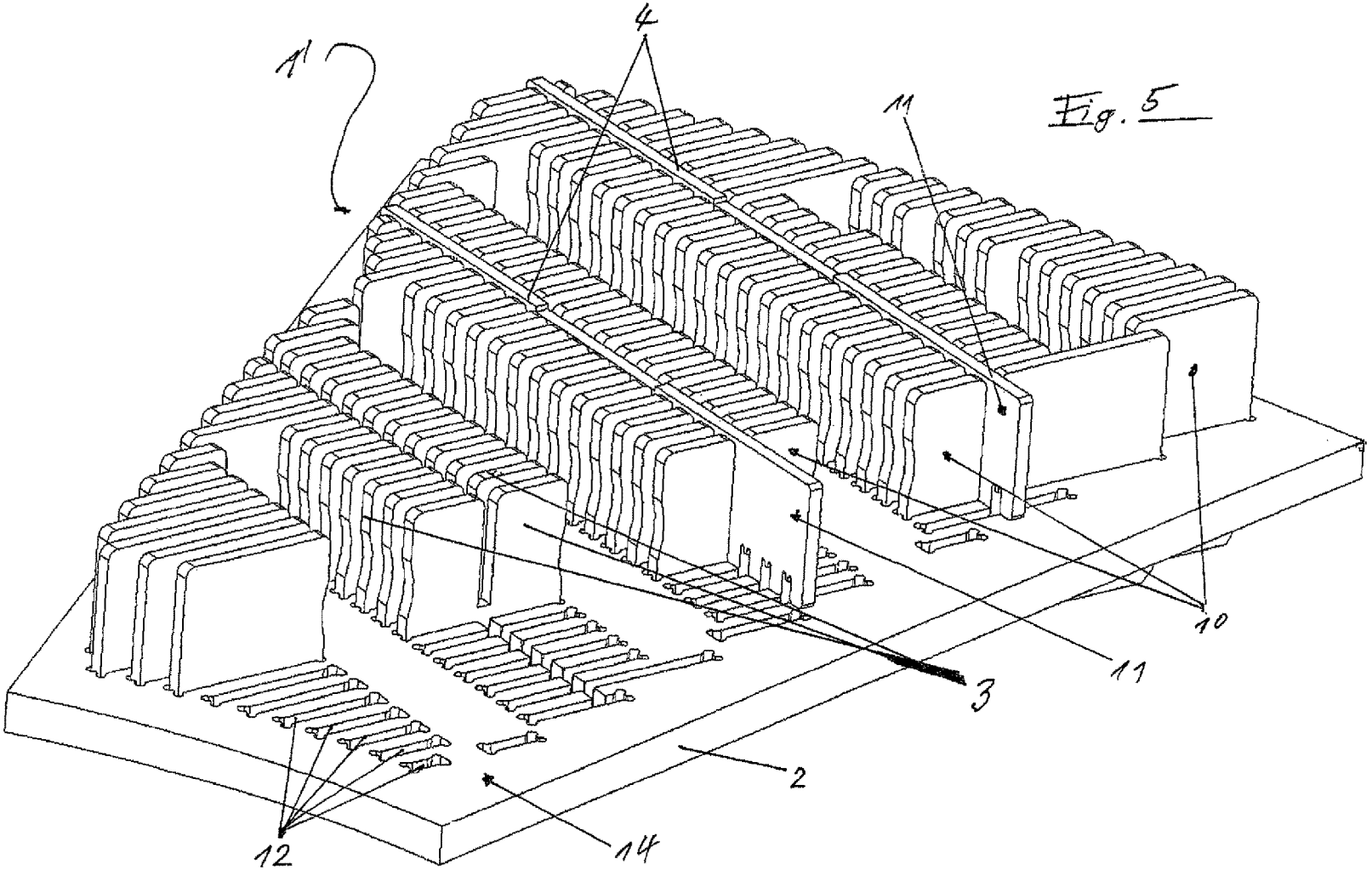

An embodiment is shown with reference to FIGS. 2 and 3, wherein the dam-like transverse stiffening elements 4, like the blade-shaped processing elements 3, jut out only on the process-proximal side. In FIG. 3, instead of the cured cast mass layer 7 according to FIG. 1, a reinforcing plate or base plate 8 is arranged, into which at least a number of the foot regions of the processing elements 3 extend into associated receiving grooves of the base plate 8.

An embodiment variant of a set 1' is shown with reference to FIGS. 4 to 9 and includes a die plate 2, blade-shaped processing elements 3, and dam-like transverse stiffening elements 4. As can be seen from FIGS. 4 and 5, the dam-like transverse stiffening elements 4 and also the blade-shaped processing elements 3 jut out from the die plate 2 on the process-distal side. Thus, foot regions 10 of the blade-shaped processing elements and foot regions 11 of the dam-like transverse stiffening elements 4 protrude on the process-distal side. In particular, it can be seen from FIG. 5 that these protruding foot regions 10 and 11 of the blade-shaped processing elements 3 and the dam-like transverse stiffening elements are form-fittingly joined together on the rear side of the die plate 2 to form a union, with the transverse stiffening elements 4 traversing the foot regions 10 of the processing elements 3. Furthermore, it can be seen from both the preceding figures and this FIG. 5 that the dam-shaped transverse stiffening elements 4 are physically held together to form a linked structure. The dam-like transverse stiffening elements 4 are designed strip-shaped and include a plurality of regions which pass through the respective openings in the die plate 2. These receiving openings in the die plate 2 are designated by 12 in the figures of the drawing.

Figure 6:
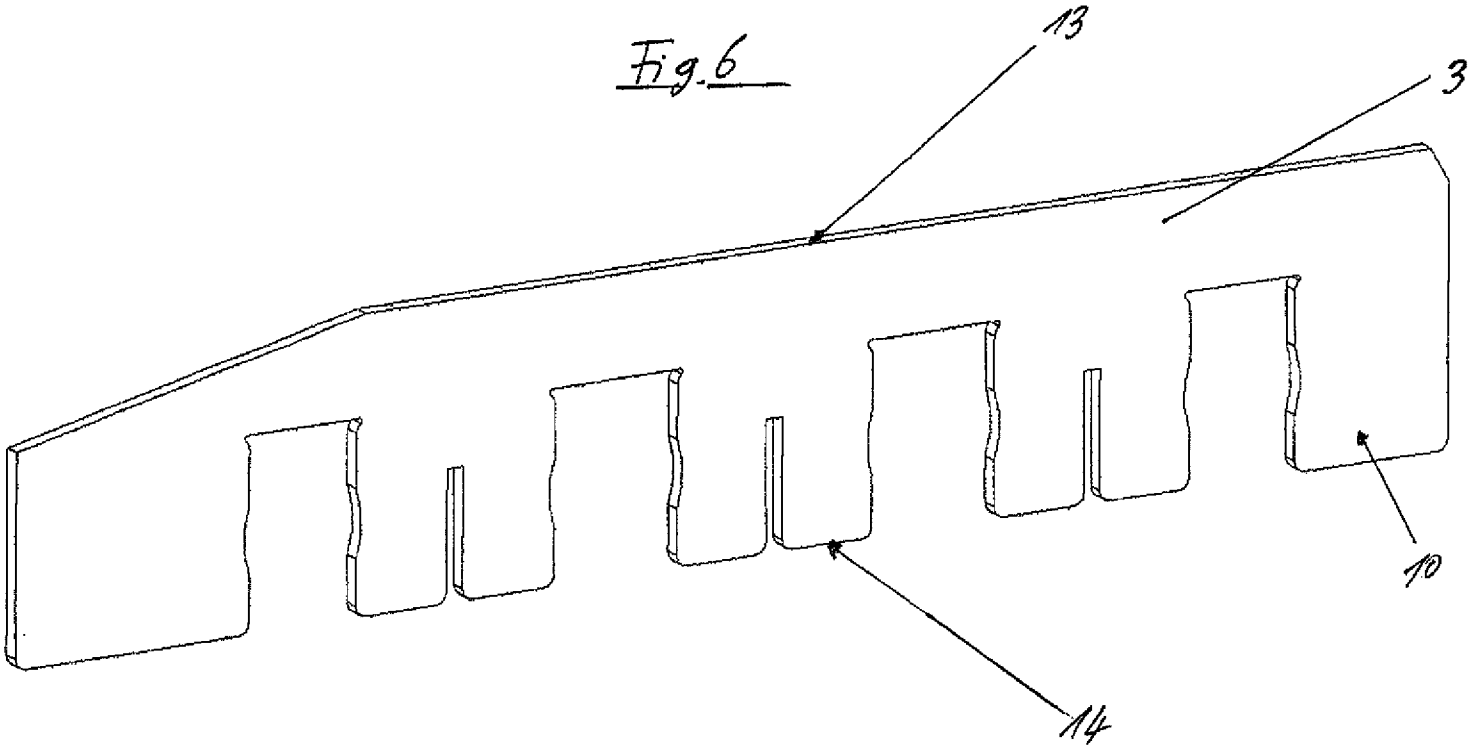
Figure 7:
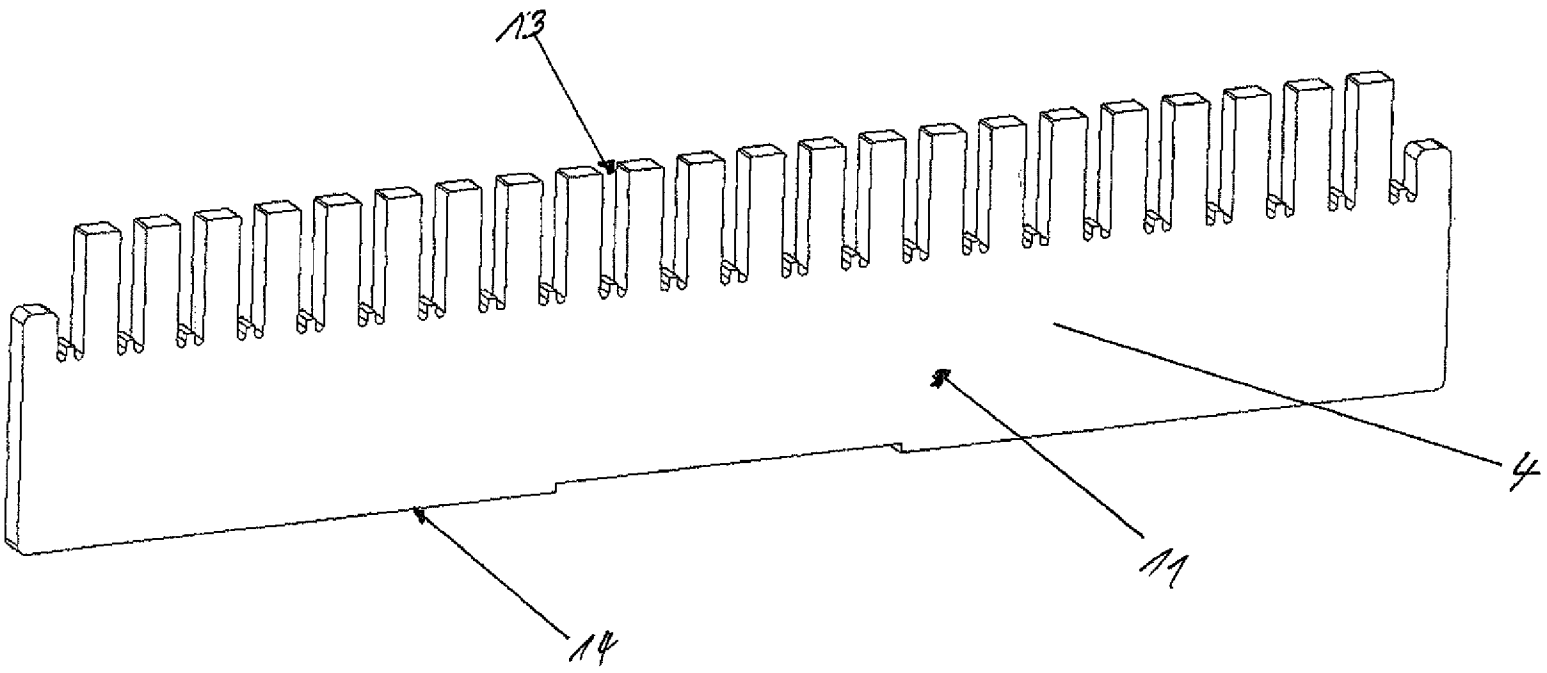
Figure 8:
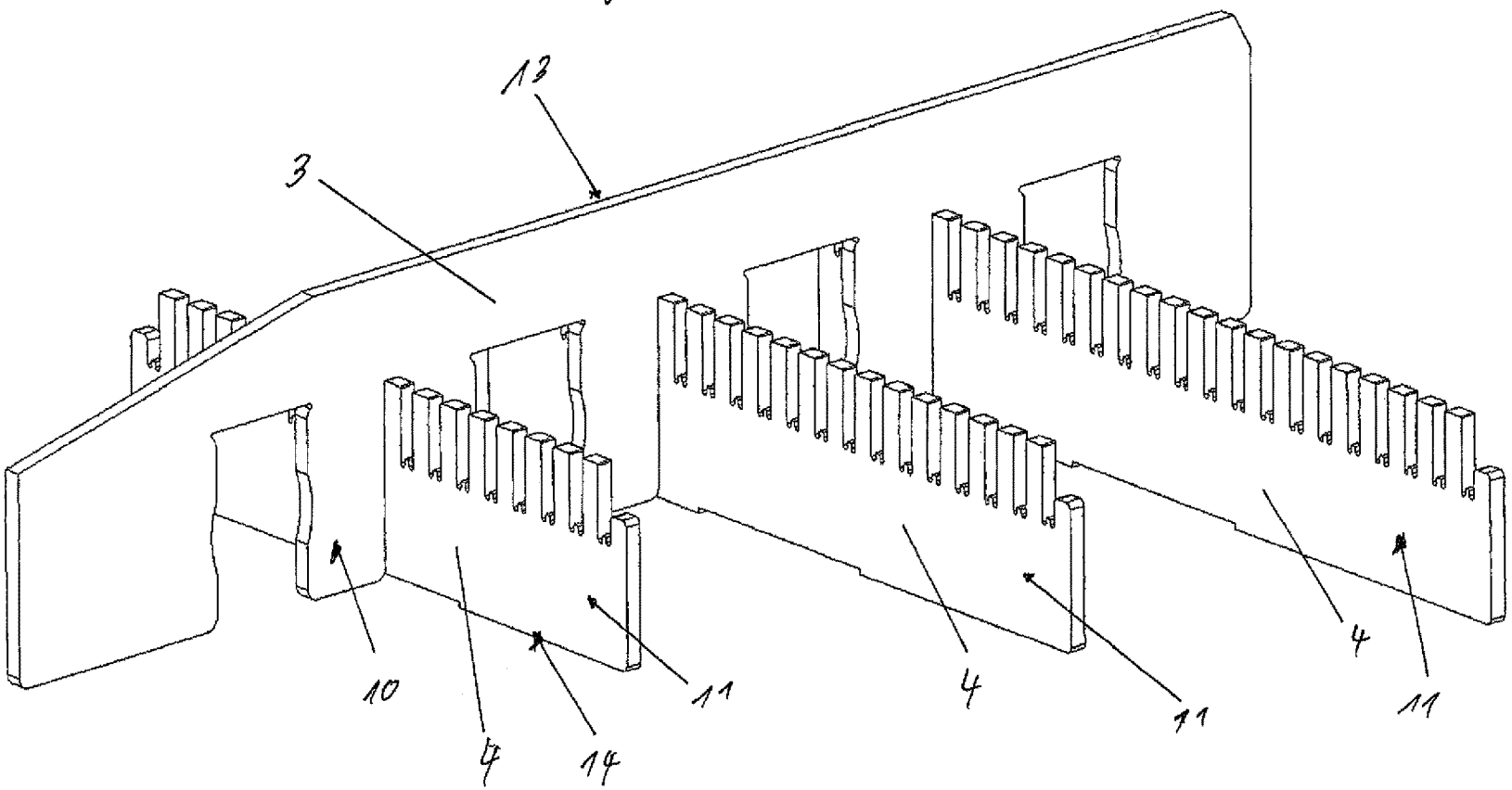

For sake of clarity, with reference to FIGS. 6 to 8, the blade-shaped processing element 3 and a dam-like transverse stiffening element 4 are illustrated as single-piece representation. FIG. 8 illustrates the interlocking arrangement of a blade-shaped processing element 3 and plurality of strip-shaped, dam-like transverse stiffening elements 4, illustrating in particular the interlocking plug-in connection. In the figures of the drawings, the process-proximal side of the sets 1, 1' is designated by 13 and the process-distal side by 14.

Figure 9:
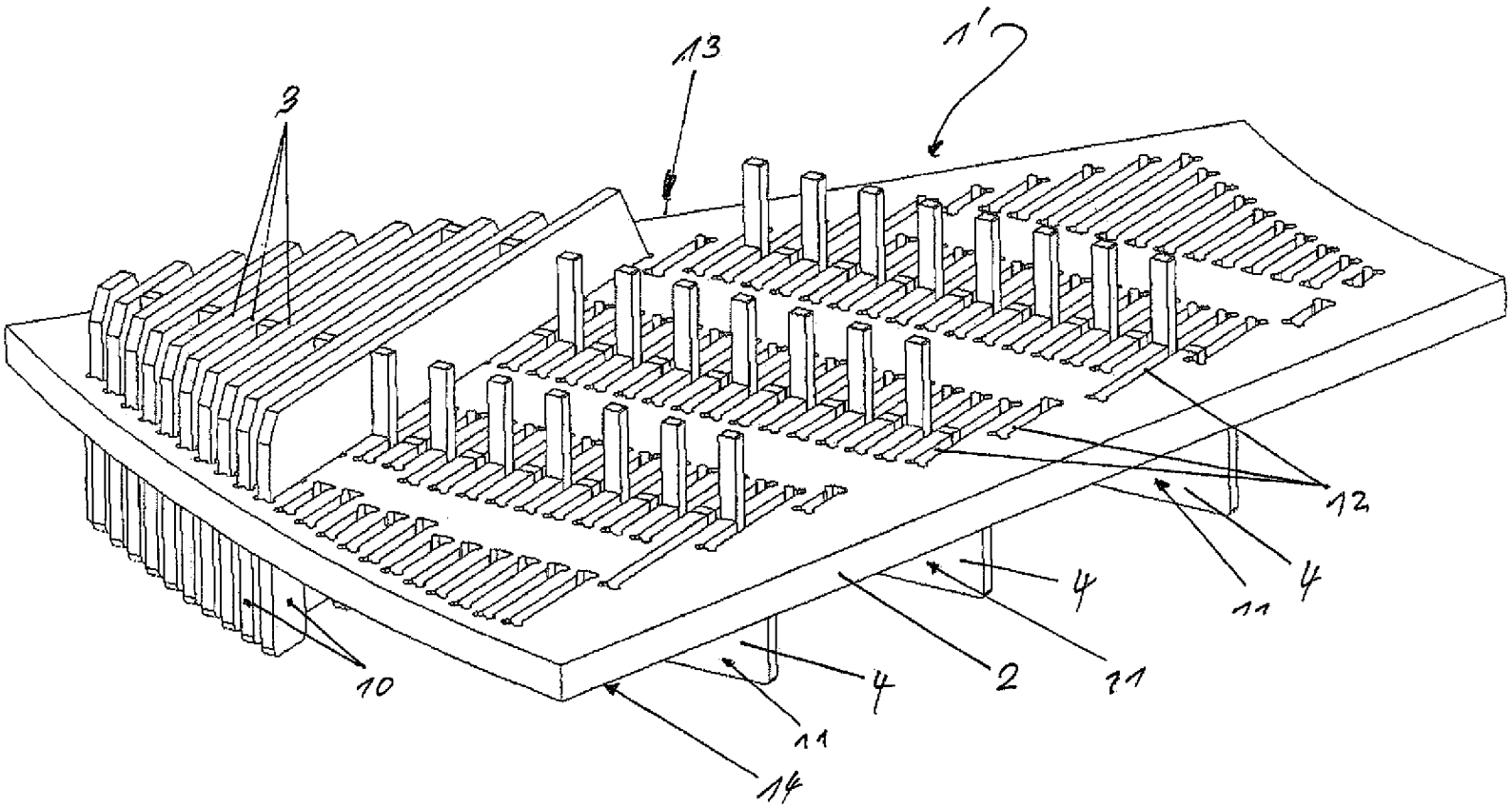

FIG. 9 shows a perspective view of a partially assembled set 1' for clarifying the assembly process, for example.

Figure 11:
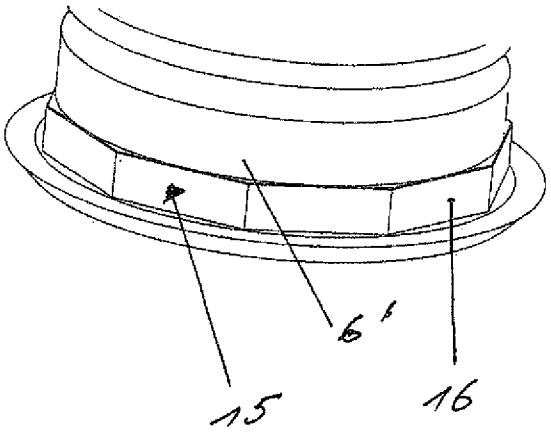
Figure 10:
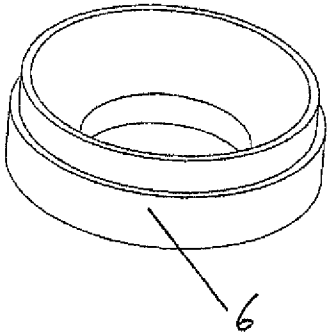

Finally, FIGS. 10 and 11 show preferred embodiments of bushings 6 for force introduction of fastening screws into openings 5 of the die plate 2, as can be seen in FIG. 1. The bushing 6 according to FIG. 10 is designed such as to be connectable to the die plate 2 by a material joint or by a combination of material joint and form-fitting connection. These may involve, for example, welded connections, soldered connections and/or adhesive bonds.

In the embodiment of the bushing 6' according to FIG. 11, an anti-rotation mechanism 15 is additionally shown, which is designed in the form of a polygon connection 16, for example.

An embodiment variant or an alternative embodiment of a set 1" is schematically shown and explained with reference to FIGS. 12 to 14. As becomes apparent from FIG. 13, the die plate or perforated plate 2 has receiving openings 12', which have alternating projections 17 that jut out in the radial direction. As can be seen from FIG. 12, the blade-shaped processing elements 3' are inserted into the receiving openings 12' such that the longitudinally spaced-apart foot regions 10 of the blade-shaped processing elements 3' are alternately in contact with the respective radial projections 17 in the receiving openings 12'. In this way, on one hand, an alignment of the blade-shaped processing elements 3' inserted into the die plate 2 is established, and, on the other hand, these are also clamped in a suitable manner by the projections 17 that are alternatingly oriented in a radial direction to stabilize the blade-shaped processing elements 3'.

Figure 12:
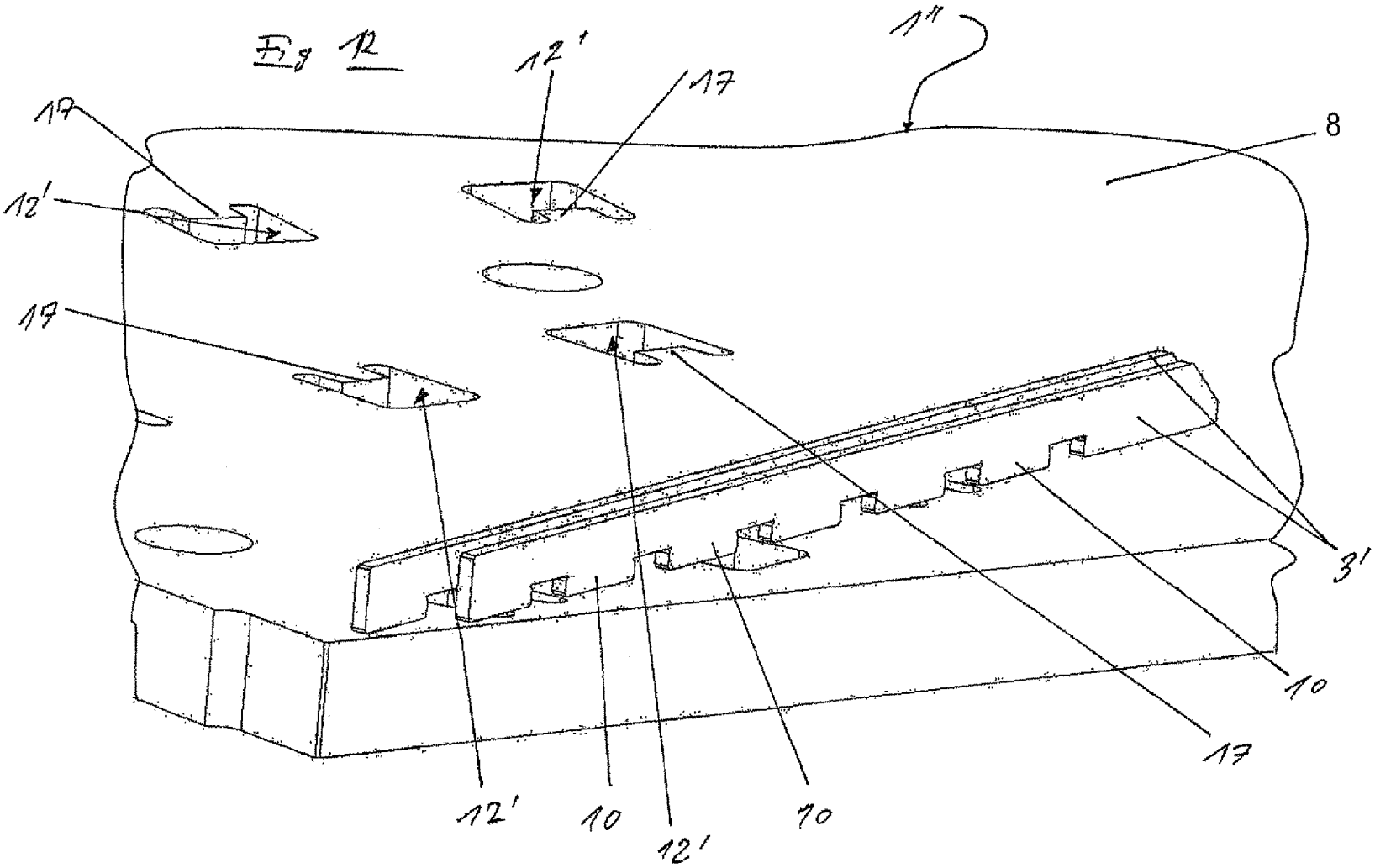
Figure 14:
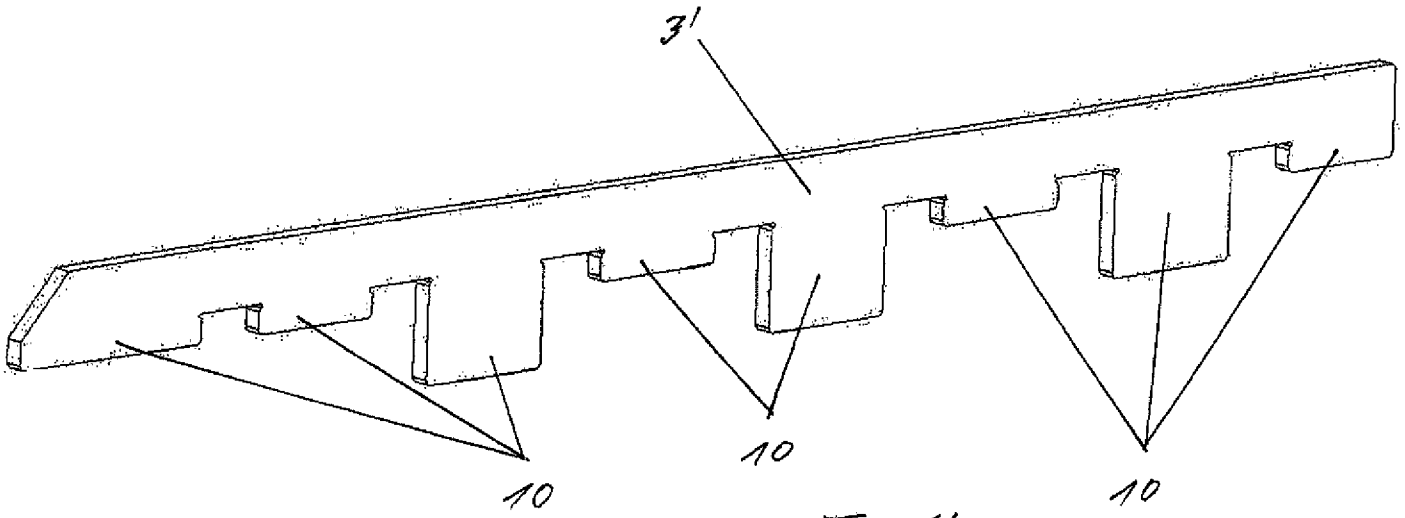

FIG. 14 shows a blade-shaped processing element 3' by way of single-piece representation, which according to FIG. 12 is inserted into the predetermined receiving openings 12' of the perforated plate 2 or die plate 2.

Figure 13:
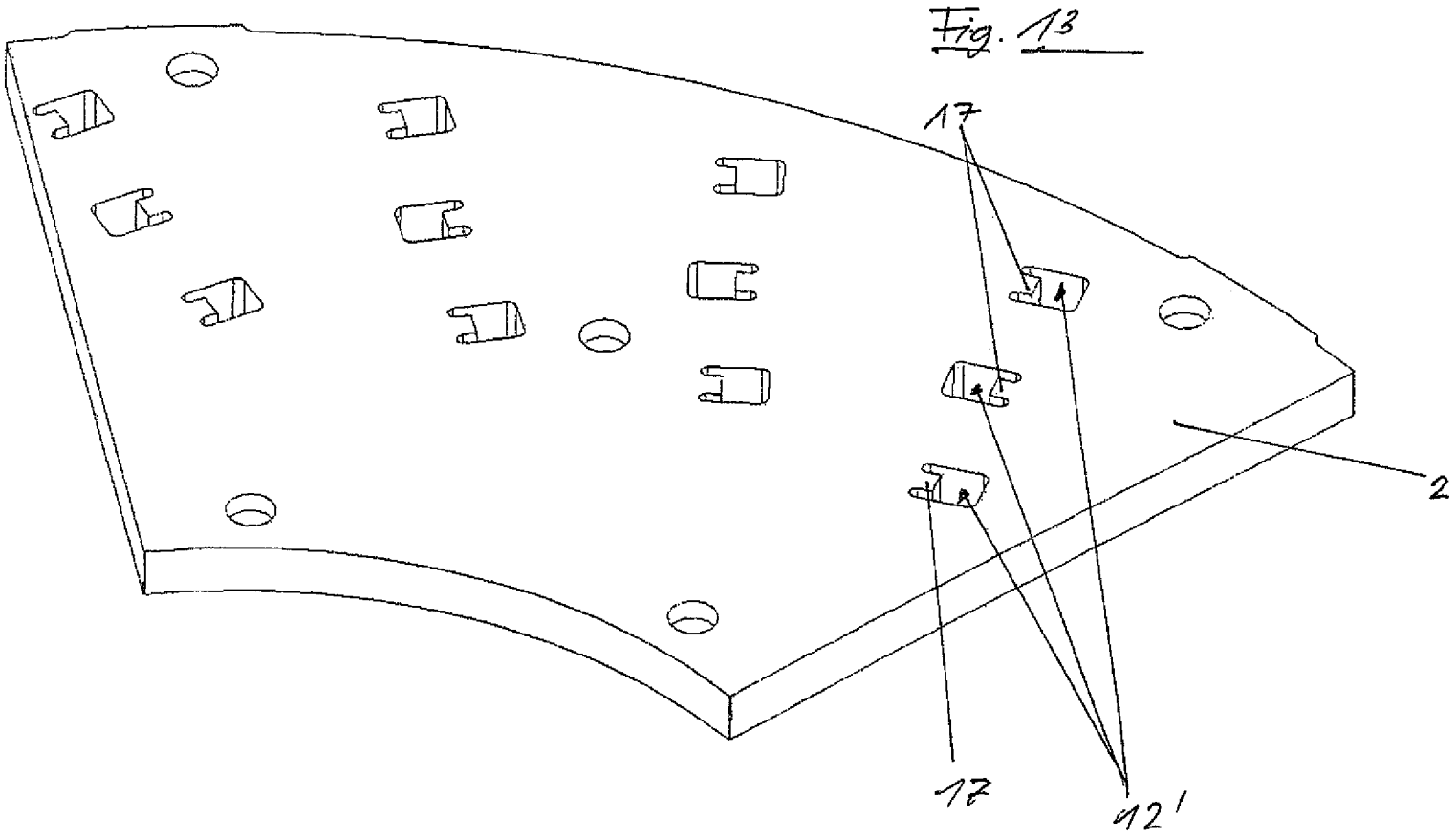

In the embodiment variant and preferred embodiment of the set 1', 2 according to FIGS. 12 to 14, no transverse stiffening elements are provided, in deviation from the embodiments explained above, but rather the longitudinally spaced foot regions 10 of the blade-shaped processing elements 3' run through the die plate 2 and are either stabilized on the process-distal side 14 either by extending into the receiving grooves 12' of the base plate 8 on the process-distal side 14, or by casting them with polymer on the process-distal side 14. Thanks to the stabilization on the process-distal side 14 and the additional fixing with the aid of the radial projections 17 in the receiving openings 12' of the die plate 2, a sufficient stabilization of the blade-shaped processing elements 3' can be reliably and securely maintained in conjunction with the perforated plate 2 and an optionally provided base plate or casting with polymer.

The invention is not limited to the above-described details of the preferred embodiments but numerous changes and modifications are possible, which the artisan can contemplate, if need be, without departing from the spirit of the invention. For example, blade-shaped processing elements 3 and dam-like transverse stiffening elements 4 can be combined with one another, which partly jut out on the foot region 10 for the die plate 2 on the process-distal side 14, and those shown in FIGS. 2 and 3. The blade-shaped processing elements 3, 3' can also be provided in different arrangements and orientations relative to one another. The same also applies, of course, to the dam-like traverse stiffening elements 4.

An essential feature of the invention is that the assembly of die plate 2, blade-shaped processing elements 3, 3' and, optionally, dam-like transverse stiffening elements 4 ensures effective mutual stiffening, which is due to the lattice-like structure of the assembly according to the invention or the anchoring of at least a number of the longitudinally spaced foot regions 10 of the blade-shaped processing elements 3, 3' in an additional base plate. Furthermore, when the dam-like transverse stiffening elements 4 are physically held together into a linked structure, installation of such a set 1, 1' is facilitated. In addition, the transverse stiffening elements 4 also have sufficient inherent stiffness. By intermeshing blade-shaped processing elements 3 and dam-like transverse stiffening elements 4, a surprisingly good inherent stiffness is obtained in the set 1, 1' according to the invention, even in the case that the blade-shaped processing elements 3 are designed very slim, i.e. have a slight thickness dimension in relation to the length and height dimensions.

What is claimed is:

1. A set for the mechanical processing of suspended fibrous material in a refiner, comprising:

a die plate having openings in a predetermined arrangement, said die plate defining a process-proximal side and a process-distal side;

a base plate adjacent to the process-distal side of the die plate; and blade-shaped processing elements inserted in the openings of the die plate and flowed upon by fibrous material on the process-proximal side, said processing elements being sized to jut out on the process-proximal side, each said processing element having a plurality of foot regions in longitudinal spaced-apart relationship, said foot regions extending through the die plate so as to jut out from the die plate on a process-distal side, at least some of the foot regions extending into receiving grooves of the base plate on the process-distal side.

2. The set of claim 1, wherein the processing elements define on the process-proximal side an overhang height of 6 to 12 mm.

3. The set of claim 1, wherein the processing elements define on the process-proximal side an overhang height of 8 to 10 mm.

4. The set of claim 1, wherein the processing elements have a width which is 1 to 6 mm.

5. The set of claim 1, wherein the processing elements have a width which is 1.5 to 2.5 mm.

6. The set of claim 1, wherein the processing elements define there between a channel width which is 1.5 to 6 mm.

7. The set of claim 1, wherein the processing elements define there between a channel width which is 1.8 to 2.5 mm.

8. The set of claim 1, further comprising bushings attached in openings of the die plate for force introduction of fastening screws.

9. The set of claim 8, wherein the bushings are connected to the die plate by a material joint or by a combination of material joint and form fit.

10. The set of claim 9, wherein the material joint is implemented by a welded connection, soldered connection and/or adhesive bond.

11. The set of claim 8, wherein the bushings have each an anti-rotation mechanism.

12. The set of claim 11, wherein the anti-rotation mechanism is formed by a polygon connection or polygonal shape.

* * * * *